United States Patent [19]

Amos

[11] Patent Number: 4,869,039

[45] Date of Patent: Sep. 26, 1989

[54] TOY BUILDING PAD

[76] Inventor: Paul Amos, 1132 Pennsylvania Ave., McKeesport, Pa. 15131

[21] Appl. No.: 232,138

[22] Filed: Aug. 15, 1988

Related U.S. Application Data

[63] Continuation-in-part of Ser. No. 040,130, April 20, 1987, now abandoned.

[51] Int. Cl.[4] ..... E04C 1/10

[52] U.S. Cl. ..... 52/585; 446/112; 446/122

[58] Field of Search ..... 52/585, 281, 285, 586, 52/311; 446/108, 111, 112, 122, 147, 476; 40/124.1, 124.2

[56] References Cited

U.S. PATENT DOCUMENTS

| | | | |
|---|---|---|---|
| 695,594 | 3/1902 | Yarnall | 52/585 |
| 723,892 | 3/1903 | Lyle | 52/585 |
| 805,665 | 11/1905 | Reagan | 52/585 |
| 1,191,884 | 7/1916 | Finch | 52/585 |
| 2,099,075 | 11/1937 | Paulson | 446/122 |
| 2,107,691 | 2/1938 | Corser | 446/122 |
| 3,960,460 | 6/1976 | Fischer | 52/585 |
| 4,365,454 | 12/1982 | Davis | 446/112 |

FOREIGN PATENT DOCUMENTS

| | | | |
|---|---|---|---|
| 543772 | 7/1957 | Canada | 446/111 |
| 2741814 | 3/1978 | Fed. Rep. of Germany | 446/112 |
| 1036934 | 9/1953 | France . | |
| 60101 | 11/1938 | Norway . | |
| 20844 | 3/1911 | United Kingdom . | |

*Primary Examiner*—David A. Scherbel
*Assistant Examiner*—Caroline D. Dennison
*Attorney, Agent, or Firm*—William J. Ruano

[57] ABSTRACT

A building pad of rectangular construction having a pair of pockets extending through the longitudinal sides thereof. The ends are closed and an identical pad is attached thereto having a pair of pockets extending through the sides thereof. Tabs are insertable in any of the pockets for attaching a similar pad edge-to-edge or side-to-side thereto. Photographs are insertable in the outermost pockets.

3 Claims, 2 Drawing Sheets

TOY BUILDING PAD

This is a continuation-in-part of my patent application Ser. No. 07/040,130 filed Apr. 20, 1987, now abandoned.

This invention relates to a building pad toy unit for interrconnection with similar pads to construct buildings or other constructions.

BACKGROUND OF THE INVENTION

Toy building pads have been attached or interconnected together for fabricating buildings and the like but they have been unsatisfactory in that the pad had limited capabilities in permitting joinder of similar pads in directions at right angles.

SUMMARY OF THE INVENTION

The building pad in accordance with the present invention involves a rectangular pad having a multiplicity of openings on each side and on each end and interconnecting tabs for joining other pads to such sides or ends. The pad is preferably of plastic material and, preferably, flexible plastic material. The tabs have central ridges or limit stops to limit the extent of penetration into the sides or ends of the building pad. Photographs or the like may be included in the outermost pocket of the pad.

DETAILED DESCRIPTION OF THE PREFERRED EMBODIMENT

Referring more particularly to FIG. 1, 2, 3 and 3*a*, they show a building pad 1, preferably of plastic material, either stiff or flexible, and which may be transparent. Numeral 2 shows one unit of the pad, which unit has two end pockets or openings 3 and 4 (FIG. 3) into which tabs, such as 7, may be projected half way, as shown, limited by an integral stop or ridge member 8. A photograph may be inserted in the outermost pocket in case of a pad of transparent plastic material, such as a photograph showing a popular ball player.

Figure 3:
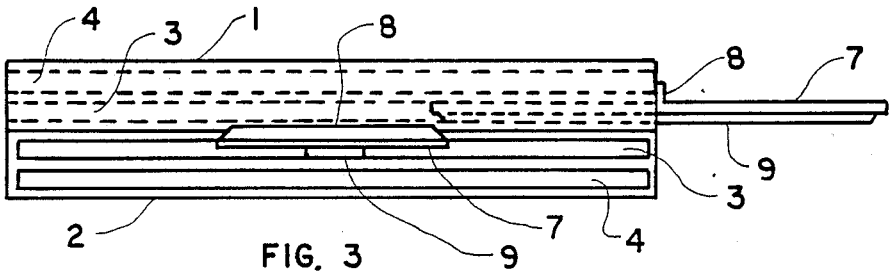
FIG. 3 is a top view of the assembly shown in FIG. 1.
Figure 1:
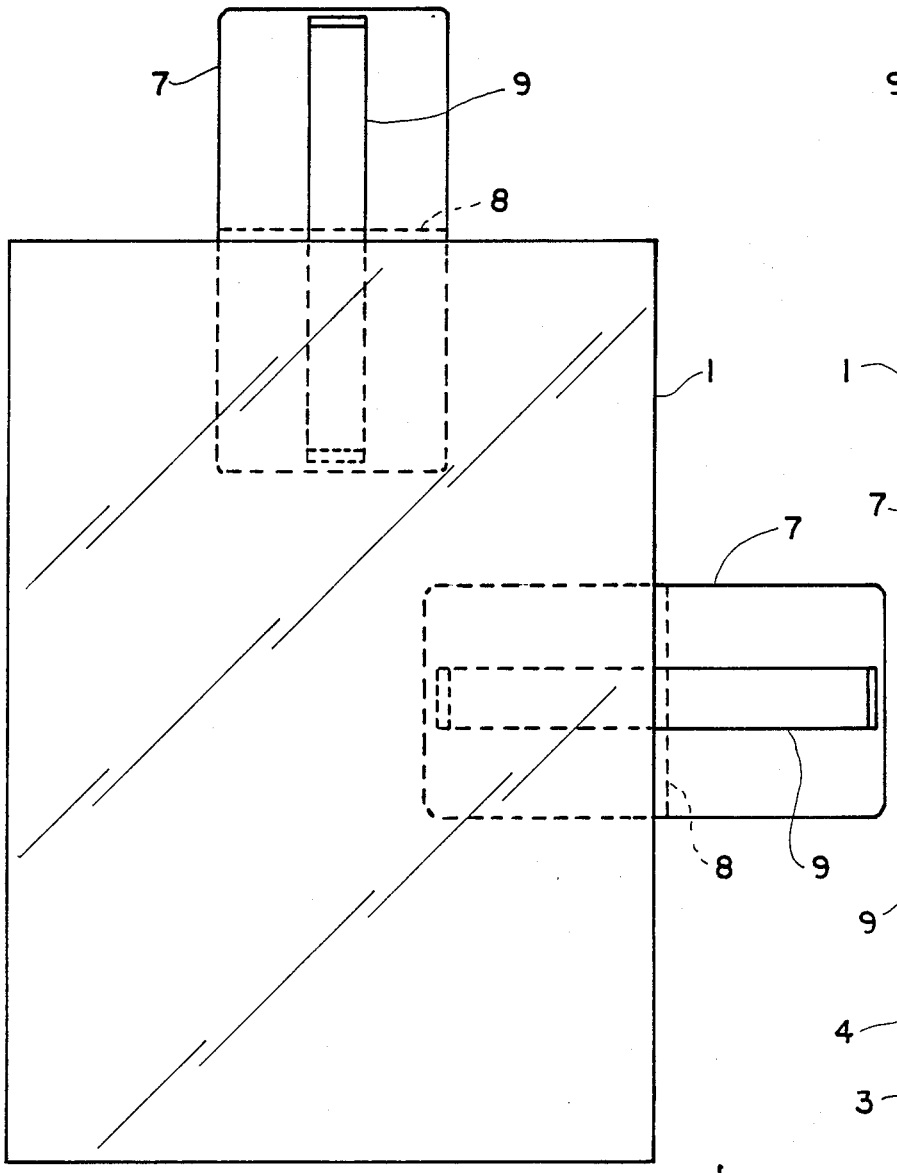
FIG. 1 is a plan or elevational view of the building pad embodying the present invention and including two separate interconnecting tabs.
Figure 2:
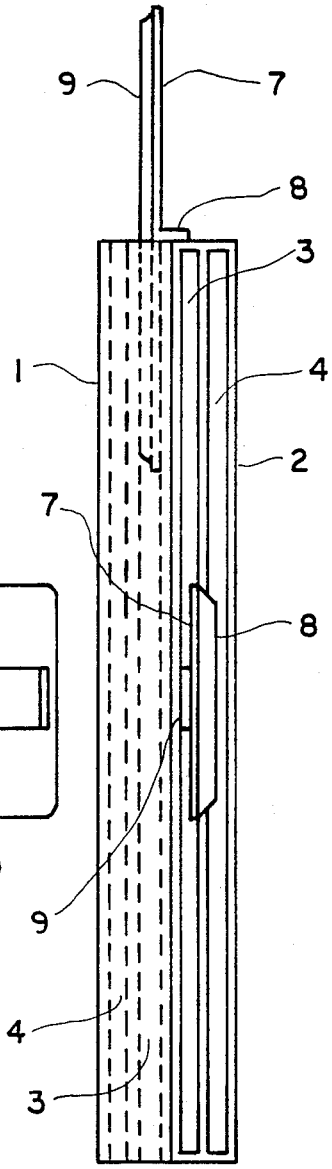
FIG. 2 is a side view of the assembly shown in FIG. 1 as viewed from the right thereof.
Figure 3A:
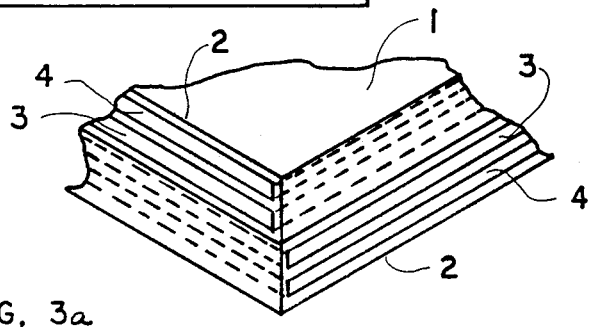
FIG. 3*a* is a fragmentary corner view of FIGS. 2 and 3.
Figure 4:
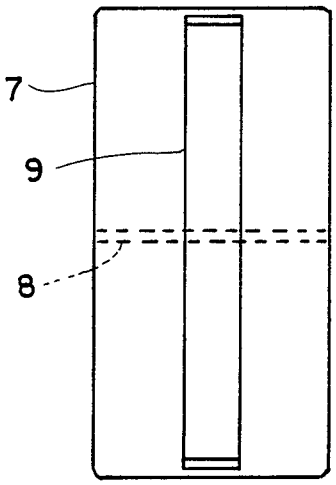
FIG. 4 is an enlarged plan view of the tab shown in FIG. 1.
Figure 5:
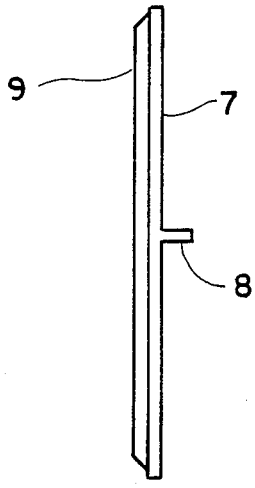
FIG. 5 is an end view viewed from the right of FIG. 4.
Figure 6:
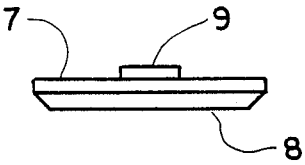
FIG. 6 is a top view of FIG. 4.

Numeral 9 denotes a wedging bridge which is thinner at the end portions as compared to the central portion, as shown more clearly in FIGS. 4 and 5. Similarly, a second unit of the building pad, attached to the first unit, is provided with two side pockets into which a tab, such as 7, and a photograph (not shown) may be inserted in the outermost pocket.

Figure 7:
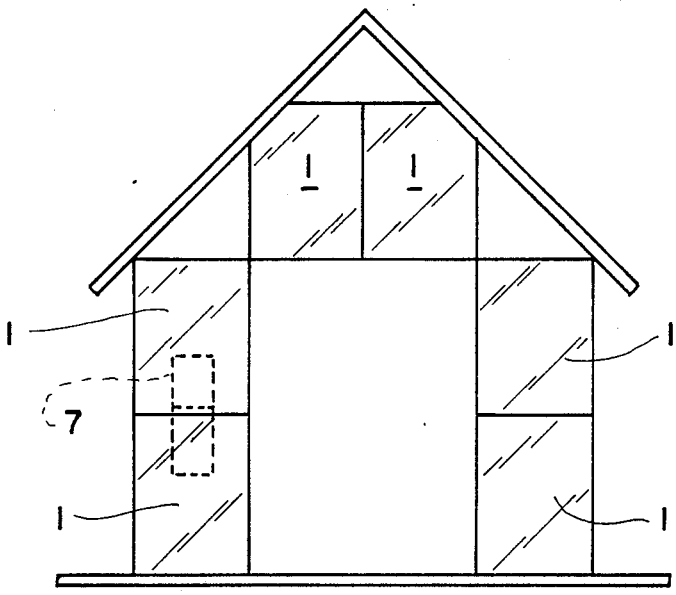
FIG. 7 shows a house that is constructed by attaching pads, such as shown in FIGS. 1–3 by means of the tabs.

FIG. 7 shows an example of what may be built by the pads 1, namely a house. The outside pockets of the pads 1 shown in FIG. 7 may be filled with poster cards or any other design to decorate the outside of the house, in which event the tabs 7 will be inserted in the end and side pockets.

While a pair of pockets is shown in the end of one of the pad units, it will be noted that since there are also a pair of pockets shown on the side of the attached pad unit this enables tabs to be inserted at right angles in the pad.

While two separate attached pads units are shown, each having a pair of pockets on opposite sides, it will be apparent that, if desired, a third building pad unit may be attached, to give a greater variety of interconnections, as well as a greater variety of posters or the like which can be inserted in opposite outer surfaces of the construction. Furthermore, by making the pads of flexible plastic, they may be assembled as a cylinder or ellipse or the like with appropriate caps at the ends.

Thus it will be seen that I have provided a novel and highly useful building pad capable of building numerous different structures, such as houses of different construction, and which can be used for adertising by inserting cards into the outer pockets of the assembly.

The building pad shown is exemplary of the smallest pad to be used, it being understood that additional pads of similar design may be attached thereto to enlarge the usefulness of the pad.

I claim:

1. A plastic rectangular, relatively thin building pad for interconnecting with other identical pads to construct a miniature structure, said pad being formed of two parallel units, each having three spaced parallel walls wherein the walls of one unit form two longitudinal pockets and the walls of the other unit form two transverse pockets in the pad, at least the outside walls of said units being transparent to expose pictorial cards that may be inserted in the outside longitudinal and transverse pockets, together with tabs insertable in any of said pockets for attaching a similar pad edge or side to side thereto.

2. A building pad as recited in claim 1, said tabs each comprising a rectangular strip having a central rib tapered outwardly at both ends.

3. A building pad as recited in claim 2 wherein each of said tabs also has a stop element on the opposite side of the tab extending centrally at right angles to said rib.

* * * * *